US010294947B2

(12) United States Patent
Wei

(10) Patent No.: US 10,294,947 B2
(45) Date of Patent: May 21, 2019

(54) ANTI-BACKFLOW DEVICE FOR FAN UNIT

(71) Applicant: Celestica Technology Consultancy (Shanghai) Co., Ltd., Shanghai (CN)

(72) Inventor: Yen Hao Wei, Shanghai (CN)

(73) Assignee: Celestica Technology Consultancy (Shanghai) Co., Ltd., Shanghai (CN)

( * ) Notice: Subject to any disclaimer, the term of this patent is extended or adjusted under 35 U.S.C. 154(b) by 567 days.

(21) Appl. No.: 14/569,211

(22) Filed: Dec. 12, 2014

(65) Prior Publication Data

US 2015/0211536 A1 Jul. 30, 2015

(30) Foreign Application Priority Data

Jan. 24, 2014 (TW) ..... 103201471 U

(51) Int. Cl.
*F04D 19/00* (2006.01)
*F04D 25/14* (2006.01)

(52) U.S. Cl.
CPC ..... *F04D 25/14* (2013.01); *F04D 19/002* (2013.01)

(58) Field of Classification Search
CPC ..... F04D 25/14; F04D 29/44; F04D 15/0016; F04D 29/524; F04D 29/563; F24F 7/077
USPC ..... 415/146, 147
See application file for complete search history.

(56) References Cited

U.S. PATENT DOCUMENTS 6,174,232 B1 * 1/2001 Stoll ..... H05K 7/20172 361/695
6,246,579 B1 * 6/2001 Lin ..... G06F 1/20 165/122
6,705,833 B2 * 3/2004 Tam ..... F04D 25/14 29/888.024
2008/0112806 A1 * 5/2008 Fan ..... F04D 25/14 415/213.1

* cited by examiner

*Primary Examiner* — Justin D Seabe
*Assistant Examiner* — Jason Mikus
(74) *Attorney, Agent, or Firm* — Nixon Peabody LLP

(57) ABSTRACT

An anti-backflow device for a fan unit, which is fabricated by cutting a rectangle thin plate, includes: a plate body defining an air outlet to permit air outflow upon activation of the fan unit, and having at least two inner peripheral sides; a plurality of connection arms; and a plurality of blades. Each blade is connected a pair of the connection arms, which are in turn connected to two connecting holes formed in the inner peripheral sides of the plate body.

17 Claims, 6 Drawing Sheets

ANTI-BACKFLOW DEVICE FOR FAN UNIT

CROSS-REFERENCE TO RELATED APPLICATION

This application claims the priority of Taiwanese patent application No. 103201471, filed on Jan. 24, 2014, which is incorporated herewith by reference.

BACKGROUND OF THE INVENTION

1. Field of the Invention

The present invention relates generally to an anti-backflow device, and more particularly to an anti-backflow device for used in a fan unit so as to prevent occurrence of air backflow into the fan unit upon activation thereof.

2. The Prior Arts

Rapid advance of science technology results in ceaseless development of electronic products. The functions thereof are still rising as days go by so do the features, but the manufacturing cost is forced to reduce nevertheless. Therefore, only high efficient function or design with low manufacturing cost is a trend for the manufactures to follow in order to satisfy the demand of the majority of the consumers.

The more the functions and features an electronic product possesses, the more the heat is generated by several components of the electronic product. The generated heat may cause damage more or less to the entire system installed in the electronic product, thereby resulting in malfunction of the electronic product. A major research for all the manufactures of electronic devices is how to dissipate the generated heat effectively with little cost and with little expense. Presently, a fan unit is provided in a majority of the electronic devices in order to dissipate the generated heat upon operation of the electronic devices.

FIG. 1 shows a conventional fan unit installed in an electronic device, such as a PC (Personal Computer) or a server system, which is used to dissipate out the generated heat therein upon activation of the fan unit. The conventional fan unit includes a frame body (*b*) and a fan (*a*) mounted rotatably in the frame body (*b*) so as to create an air flow upon activation of the fan unit so that the generated heat in an interior of the electronic device is dissipated to an exterior of the electronic device with the air flow. One drawback resulted from the use of the fan unit resides in that an air backflow is generated in case the fan unit malfunctions or is deactivated. To be more specific, the backflow is an unwanted reverse flow. The backflow is generally occurred and more aggravated in those devices or systems which have cross connection of fluid supplies, like plumbing fixtures or piping systems. The air backflow into the product sometimes causes the operating system unstable. In order to eliminate this drawback, some manufacturers have installed anti-backflow devices, like shutter types, in most of the devices so as to prevent the occurrence of unwanted reverse flow, simply "backflow".

SUMMARY OF THE INVENTION

A primary objective of the present invention is to eliminate the backflow problem in an electronic device. Presently, there are several shuttle types of anti-backflow devices are used. However, a relatively small fan unit with dimension 40 mm×40 mm or 38 mm×38 mm is seldom used owing to difficulties of manufacturing the small fan unit and installation of an air shielding cover onto the fan unit.

Another objective of the present invention to provide a fan unit, in which a relatively thin plate with specific configuration is used as an anti-backflow device so as to prevent occurrence of backflow in the fan unit.

An anti-backflow device of the present invention is used in a fan unit. The device is fabricated by cutting a rectangle thin plate and includes: a plate body defining an air outlet to permit air outflow upon activation of the fan unit; and a plurality of first blades arranged in a parallel manner relative to one another in the width direction of the air outlet of the plate body, each of the first blades has two opposite connecting arms that extend in a longitudinal direction of the air outlet of the plate body and that are adjacent to both lateral sides of an adjacent one of said parallel first blades and two connecting holes formed on two ends of the connecting arms, wherein the plurality of connecting arms and the plurality of first blades are fabricated by cutting the rectangle thin plate, wherein the plurality of connecting arms rotate to permit turning of the plurality of first blades outward with respect to the air outlet of the plate body. Preferably, the connecting holes are beneficial to facilitate turning of the respective pair of connecting arms.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

The accompanying drawings are included to provide a further understanding of the invention, and are incorporated in and constitute a part of this specification. The drawings illustrate embodiments of the invention and, together with the description, serve to explain the principles of the invention.

Figure 1:
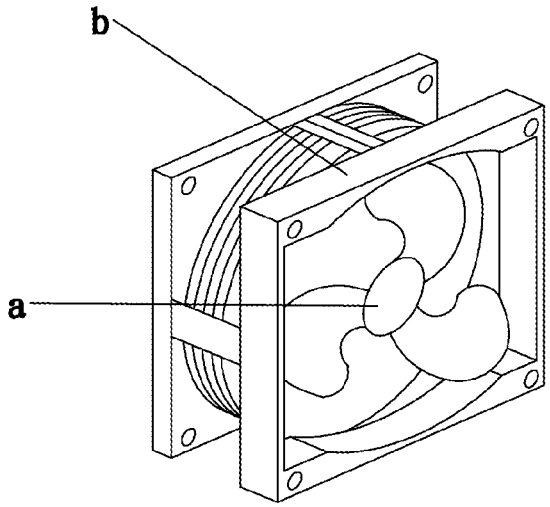
FIG. 1 (Prior Art)
FIG. 1 shows a conventional fan unit installed in an electronic device.
Figure 2:
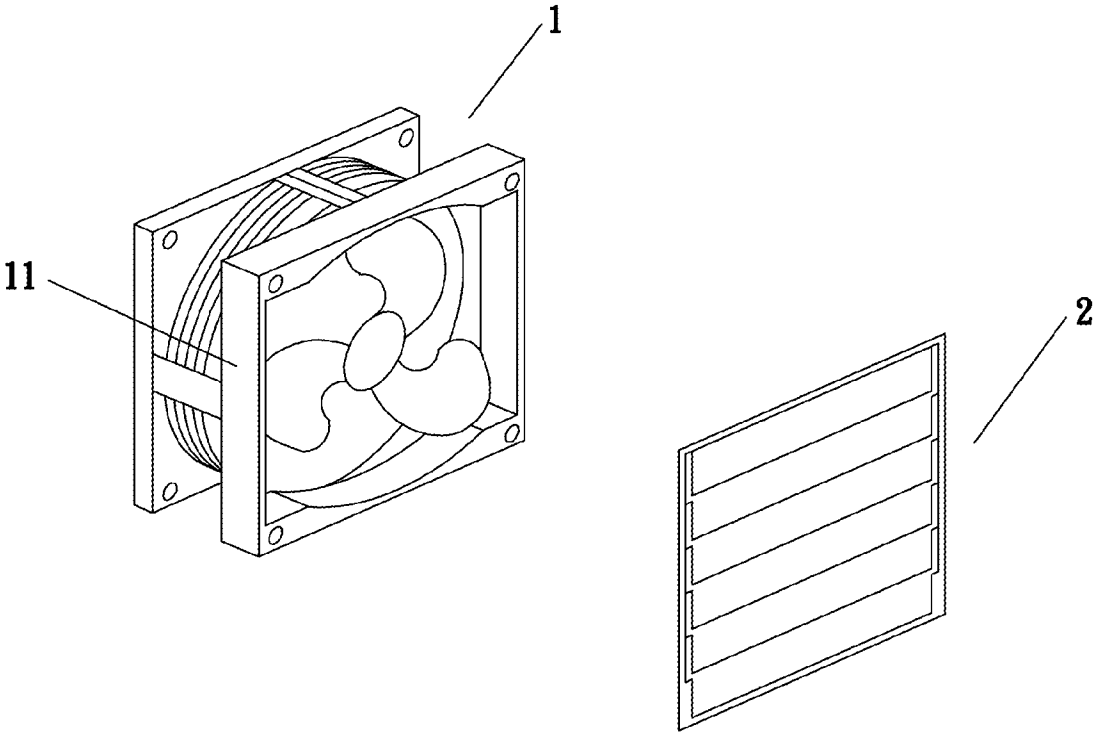
FIG. 2 illustrates an anti-backflow device of the present invention together with a fan unit.
Figure 3:
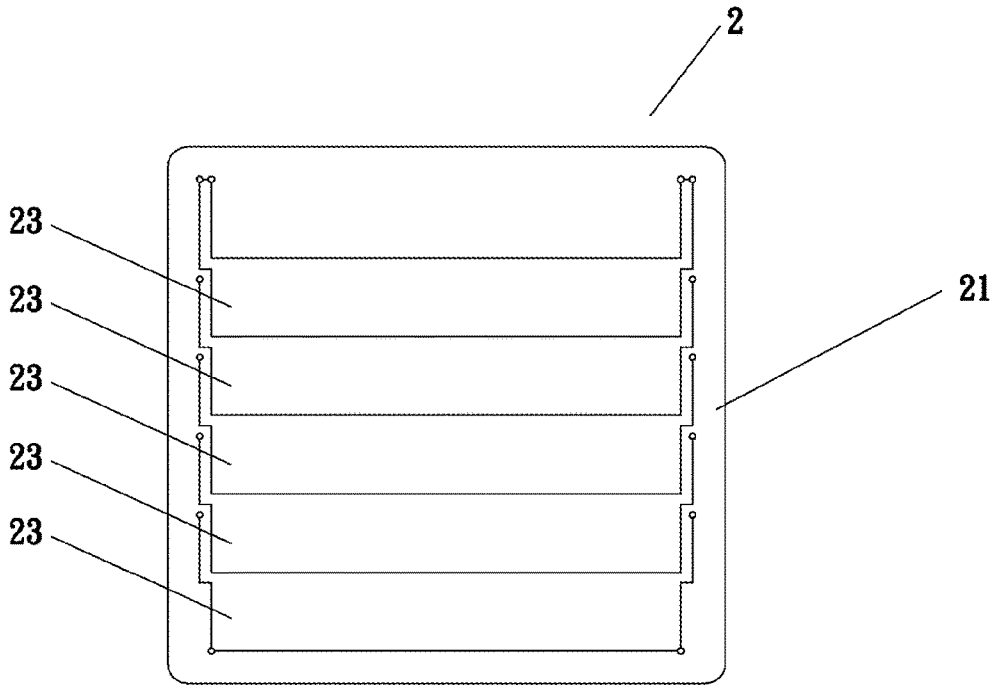
FIG. 3 is a front planar view of the anti-backflow device of the present invention.

FIG. 2 illustrates an anti-backflow device of the present invention shown together with a fan unit. The fan unit 1 employed in the present invention has a dimension of 40 mm×40 mm or 38 mm×38 mm, however the dimension should not be limited only the disclosed ones. The fan unit 1 generally includes a mounting frame 11 defining an air outlet.

The anti-backflow device of the present invention is fabricated by cutting a rectangle thin plate 2 so as to include a plate body 21, a plurality of connecting arms 22 and a plurality of first blades 23 arranged in a parallel manner relative to one another. After fabrication, the plate body 21 is attached securely to the mounting frame 11 of the fan unit 1.

The plate body 21 defines an air outlet (not visible) to permit air outflow upon activation of the fan unit 1. To be more specific, the air outlet of the plate body 21 is in communication with the air outlet defined by the mounting frame 11 of the fan unit 1 once the anti-backflow device of the present invention is installed on the fan unit 1 (see FIG. 5) such that the plurality of first blades 23 are arranged in a parallel manner relative to one another in the width direction of the outlet of the plate body 21. The plate body 21 has at least two inner peripheral sides.

Each first blade 23 has two opposite connecting arms 22 that extend in a longitudinal direction of the outlet of the plate body 21 and that are adjacent to both lateral sides of an adjacent one of the first blades 23 and two connecting holes 24 formed on two ends of the connecting arms 22. It is noted that each first blade 23 is relatively light in weight and to prevent the same from being easily blown away from the plate body 21, two opposite lateral sides of each first blade 23 are integrally formed with the pair of connecting arms 22 so as to reinforce and increase the overall rigidity thereof.

In this embodiment, the plate body 21, the plurality of and the plurality of blades 23 are integrally formed with one another owing to cutting in non-seperable method and cooperatively define a total surface area generally equivalent to an entire surface area of the thin plate 2. Preferably, each of the connecting arms 22 has a width equivalent to a gap defined between one lateral side of the first blade 23 and one of the inner peripheral sides of the plate body 21 adjacent to the lateral side of the first blade 23. Each of the connecting arms 22 further has a longitudinal length equivalent to a length of each of the blades. Under this condition, once the anti-backflow device of the present invention is installed on the fan unit 1 and when the fan unit 1 is in a non-use state, the plurality of the blades 23 cooperatively cover the air outlet of the plate body 21 so that no air backflow is generated owing to the entire surface area of the plate body 21 is covered by the first blades 23 (see FIG. 5).

In this embodiment, the thin plate 2 is preferably fabricated from Mylar™, and has a thickness equivalent to or less than 0.4 mm.

Figure 5:
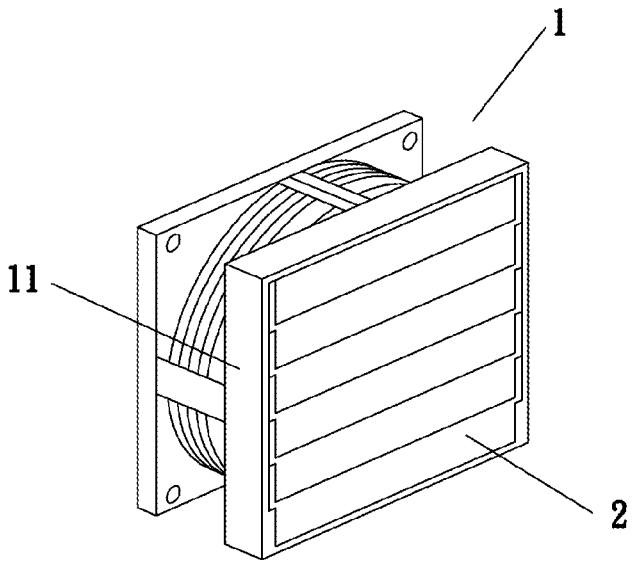
FIG. 5 is a perspective view of the anti-backflow device of the present invention installed to a fan unit, wherein the fan unit is in a non-use state.

More preferably, the plurality of first blades 23 cooperatively define a total surface area generally equivalent to an entire surface area of the air outlet of the fan unit 1 so that the plurality of blades 23 cover the air outlet of the plate body 21 in their initial state (owing the gravitational force thereof), hence the air outlet of the fan unit 1 is also covered by the plurality of the first blades 23, as best shown in FIG. 5 in case the fan unit 1 is not in use so as to prevent occurrence of backflow phenomenon in the fan unit 1.

Figure 4:
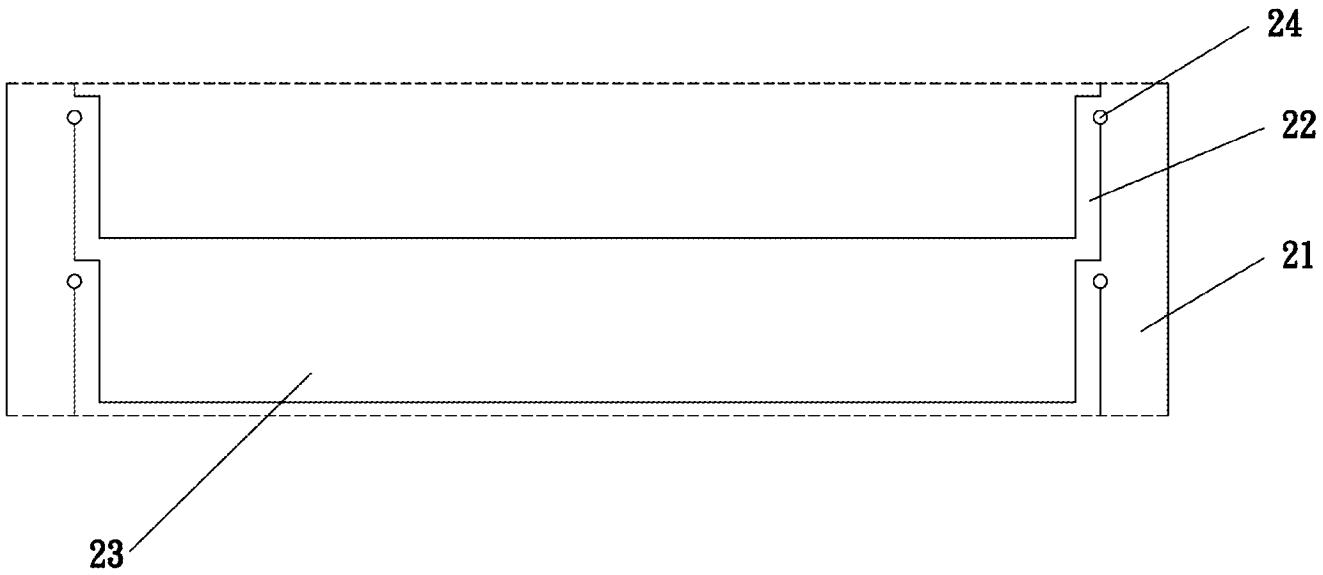
FIG. 4 is an enlarged view of a fragmentary portion of the anti-backflow device of the present invention.
Figure 6:
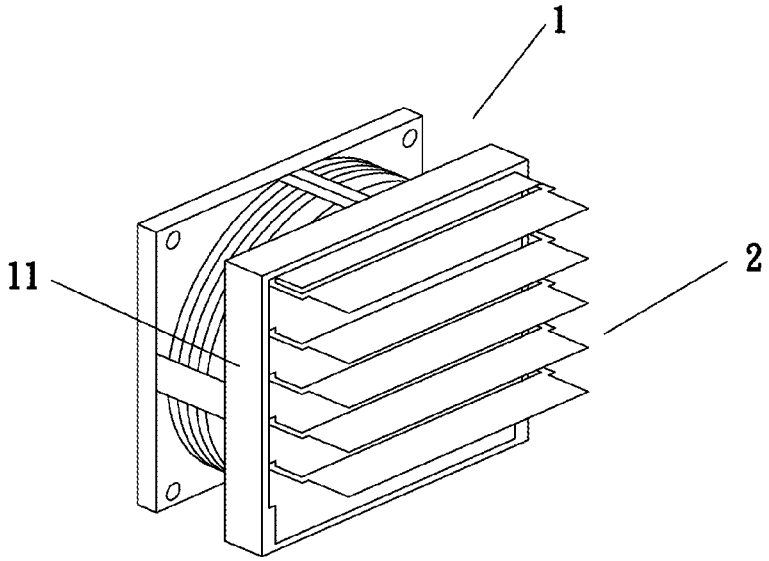
FIG. 6 is a perspective view of the anti-backflow device of the present invention installed to the fan unit, wherein the fan unit is in a use state.

It is to note that in order to facilitate turning of the connecting arms 22, the two top ends of two connecting arms 22 integrally formed two opposite lateral sides of each first blade 23 are generally flush with the connecting holes 24 formed in the inner peripheral sides of the plate body 21 (see FIG. 4). To permit turning of the first blades 23 with respect to the plate body 21, the connecting holes 24 are beneficial for preventing the top end of the connecting arms 22 from breaking so that upon activation of the fan unit 1, the connecting arms 22 rotate in the connecting holes 24 to permit turning of the first blades 23 outward relative to the plate body 21 due to the air outflow in the downstream, as best shown in FIG. 6. In this embodiment, each of the connecting holes 24 is a circular hole.

Figure 7:
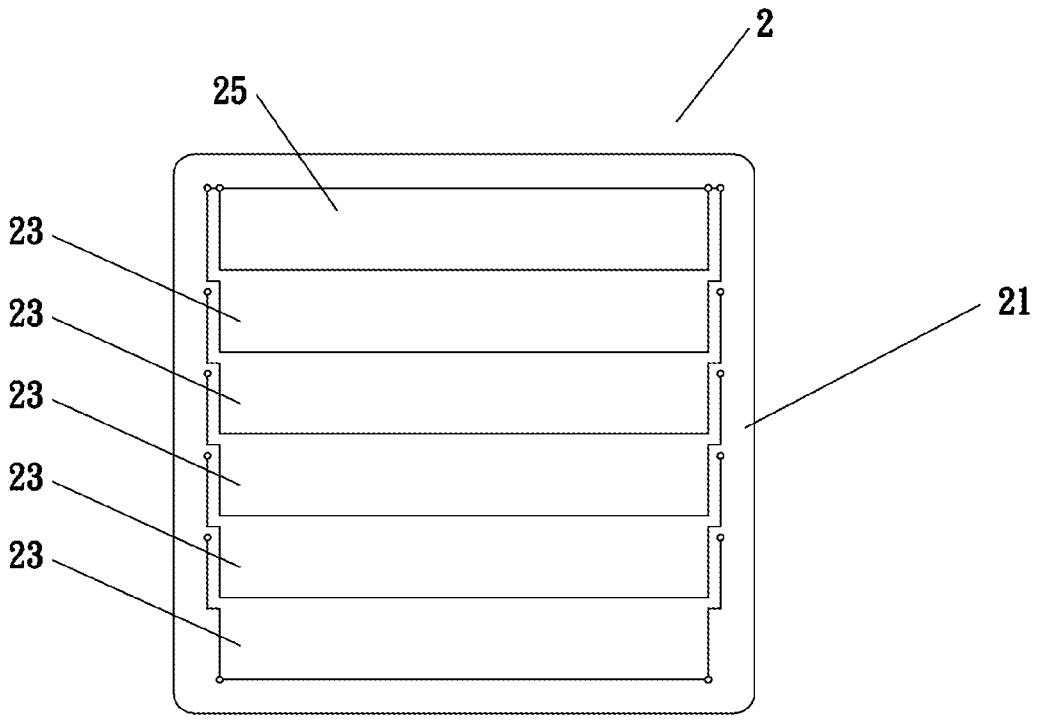
FIG. 7 is a front planar view of the anti-backflow device of the present invention in another side.

Referring to FIG. 7, the anti-backflow device of the present invention further includes at least one second blade 25 having two opposite lateral sides connected to another pair of connecting holes 24 formed on two top ends of an another pair of extra connecting arms 22 inboard to the connecting holes 24 receiving the top most one of the first blades 23. In this embodiment, the plurality of first blades 23 and the second a blade 25 cooperatively define a total surface area equivalent to an entire surface area of the air outlet of the fan unit (not visible). When the fan unit 1 is installed with the anti-backflow device of the present invention is not in use, the air outlet of the fan unit is covered entirely by a combination of the second blade 25 and the plurality of first blades 23. So no backflow effect is resulted in the fan unit 1. Note that in this embodiment, the anti-backflow device of the present invention further includes an extra pair of connecting arms for connecting the two opposite lateral sides of the second blade 25 to another pair of connecting holes 24. Each extra connection arm has a width equivalent to a distance defined between one of the inner peripheral sides and one lateral side of the second blade 25 adjacent to said one of the inner peripheral sides. Another thing to note is that since the two opposite lateral sides of the second blade 25 serve and function as the extra pair of connecting arms such that each of the extra pair of connecting arms has a length equivalent to a width of the second blade 25.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. An anti-backflow device for a fan unit that includes a mounting frame with an air outlet, the anti-backflow device fabricated by cutting a rectangle thin plate and comprising:

a plate body adapted to be attached to the mounting frame of the fan unit, said plate body defining an air outlet in communication with the air outlet of the mounting frame to permit air outflow upon activation of the fan unit;

and a plurality of first blades arranged in a parallel manner relative to one another in the width direction of the air outlet of the plate body, each of the first blades has two opposite connecting arms that extend in a longitudinal direction of the the air outlet of the plate body and that are adjacent to two opposite lateral sides of an adjacent one of said parallel first blades and two connecting holes formed on two ends of the connecting arms, wherein the plurality of connecting arms and the plurality of first blades are fabricated by cutting the rectangle thin plate, wherein the plurality of connecting arms rotate at the connecting holes to permit turning of the plurality of first blades outward with respect to the air outlet of the plate body.

2. The anti-backflow device according to claim 1, wherein each of said connecting arms has a width equivalent to a gap defined between one lateral side of said first blade and one of inner peripheral sides of said plate body adjacent to said one lateral side of said first blade.

3. The anti-backflow device according to claim 1, wherein each of said connecting arms has a longitudinal length equivalent to a length of each of said first blades.

4. The anti-backflow device according to claim 1, wherein said plate body, said plurality of connecting arms and said plurality of first blades cooperatively define a total surface area generally equivalent to an entire surface area of said thin plate.

5. The anti-backflow device according to claim 1, wherein said pair of connecting arms having two top ends generally flush with said connecting holes to facilitate turning of said pair of connecting arms at said connecting holes.

6. The anti-backflow device according to claim 1, wherein said plate body defines a total surface area generally equivalent to an entire surface area of said thin plate.

7. The anti-backflow device according to claim 1, wherein said plurality of first blades cooperatively define a total surface area generally equivalent to an entire surface area of the air outlet of the fan unit, which is in spatial communication with said air outlet defined by said plate body.

8. The anti-backflow device according to claim 1, wherein said thin plate has a thickness less than 0.4 mm.

9. The anti-backflow device according to claim 1, wherein said thin plate has a thickness of 0.4 mm.

10. The anti-backflow device according to claim 1, wherein the fan unit has a dimension of 40 mm×40 mm.

11. The anti-backflow device according to claim 1, wherein the fan unit has a dimension of 38 mm×38 mm.

12. The anti-backflow device according to claim 1, further comprising at least one second blade having two opposite lateral sides connected to another pair of connecting holes inboard to said two connecting holes respectively.

13. The anti-backflow device according to claim 12, wherein said plurality of first blades and said second blade cooperatively define a total surface area equivalent to an entire surface area of the air outlet of the fan unit.

14. The anti-backflow device according to claim 12, further comprising an extra pair of connecting arms for connecting said two opposite lateral sides of said second blade to said another pair of connecting holes, wherein each extra connection arm has a width equivalent to a distance defined between one of inner peripheral sides and one lateral side of said second connection arm adjacent to said one of said inner peripheral sides.

15. The anti-backflow device according to claim 12, wherein said another pair of connecting holes, with which said two opposite lateral sides of said second blade are connected respectively, are formed inboard to said connecting holes.

16. The anti-backflow device according to claim 12, wherein each of said connecting holes and said another pair of connecting holes is a circular hole.

17. The anti-backflow device according to claim 12, wherein each of said connecting holes and said another pair of connecting holes has polygonal inner side surfaces.

* * * * *